United States Patent [19]

Heitkamp et al.

[11] 4,343,512

[45] Aug. 10, 1982

[54] CUTTER DRIVE REGULATION APPARATUS FOR A TUNNELLING MACHINE

[75] Inventors: Herbert Heitkamp, Werne; Werner Dehmel, Lünen, both of Fed. Rep. of Germany

[73] Assignee: Gewerkschaft Eisenhütte Westfalia, Lünen, Fed. Rep. of Germany

[21] Appl. No.: 178,419

[22] Filed: Aug. 15, 1980

[30] Foreign Application Priority Data

Aug. 18, 1979 [DE] Fed. Rep. of Germany ..... 2933597

[51] Int. Cl.[3] ..... E21D 9/08

[52] U.S. Cl. ..... 299/1; 299/31; 299/75

[58] Field of Search ..... 299/1, 31, 33, 75; 37/DIG. 1; 172/3

[56] References Cited

U.S. PATENT DOCUMENTS 2,136,921 11/1938 Joy ..... 299/1
2,795,408 6/1957 Goodrich ..... 299/1 X
4,136,910 1/1979 Plummer ..... 299/33 X
4,173,836 11/1979 Paurat ..... 37/DIG. 1

*Primary Examiner*—Ernest R. Purser
*Attorney, Agent, or Firm*—Sughrue, Mion, Zinn, Macpeak and Seas

[57] ABSTRACT

Apparatus is disclosed for regulating the capacity of a tunnelling machine. The tunnelling machine is of the type having a rotatable cutting head mounted at one end of an arm. The other end of the arm is pivotally mounted on a carrier about a pivot pin whose axis extends transversely to the axis of the arm. A hydraulic rotary drive is provided for rotating the arm about the axis of the tunnel being formed. The regulation apparatus includes a regulator for regulating the rotary drive of the arm in dependence upon the capacity of the cutting head drive. An angle/current transducer is provided for measuring the angle between the axes of the arm and the tunnel. The regulation apparatus is such that the capacity of the cutting head drive decreases as said angle decreases, the reduction in capacity being effected by a reduction in the force applied by the cutting head to the working face.

12 Claims, 2 Drawing Figures

CUTTER DRIVE REGULATION APPARATUS FOR A TUNNELLING MACHINE

BACKGROUND TO THE INVENTION

This invention relates to apparatus for regulating the capacity of a tunnelling machine.

A known tunnelling machine has a chassis, an arm pivotally mounted on the chassis about a pivot pin whose axis extends transversely to the axis of the arm, and a rotatable cutting head mounted at the free end of the arm. The cutting head is driven by means of a rotary drive about the axis of the tunnel being formed. Throughout this specification, the term "tunnel" is intended to include a mine gallery or other elongate excavation.

It is possible, with this type of tunnelling machine, to drive a tunnel having a circular and smooth-walled cross-section by making a series of concentric cuts, the centre-points of which are disposed along the axis of the tunnel. In use, efforts are made to make the fullest possible use of the capacity of the cutting head drive, even when the earth or the rock is not of a uniform consistency. Unfortunately, the arm of such a machine (and the bearings supporting the arm) must be extremely robust, heavy and expensive, if the nominal capacity of the cutting head drive is to be fully utilised for all angular positions of the arm. (Tunnelling machines of this type are described in DE-OS No. 2437 683 and DE-OS No. 2437 669).

The aim of the invention is to provide regulation apparatus for a tunnelling machine which enables the capacity of the cutting head drive to be fully utilised, without it being necessary for the arm and its bearings to be of an excessively robust and expensive construction.

SUMMARY OF THE INVENTION

The present invention provides apparatus for regulating the capacity of a tunnelling machine having a rotatable cutting head mounted at one end of an arm, the other end of the arm being pivotally mounted in the chassis of the tunnelling machine about a pivot pin whose axis extends transversely to the axis of the arm, a rotary drive being provided for rotating the arm about the axis of the tunnel being formed, and a drive being provided for the cutting head, the regulation apparatus comprising a regulator for regulating the rotary drive of the arm in dependence upon the capacity of the cutting head drive, and a device for measuring the angle between the axes of the arm and the tunnel, the regulation apparatus being such that the capacity of the cutting head drive decreases as said angle decreases, the reduction in capacity being effected by a reduction in the force applied by the cutting head to the working face.

Regulation of the rate of advance and/or of the pressure applied by the cutting head to the working face (that is to say said force applied by the cutting head to the working face) in dependence upon the angle between the axes of the arm and the tunnel, enables at least the main part of the tunnelling work (that is to say the outer concentric cuts) to be carried out by using practically the entire nominal capacity of the cutting head drive. Only a small part of the tunnelling work (that is to say the innermost concentric cuts) are carried out using a reduced capacity of the cutting head drive. The fact that the full capacity of the cutting head drive is not exploited in the case of small angles, enables the arm and its bearings (and therefore the entire tunnelling machine) to be lighter in weight, less bulky and of less expensive construction, while at the same time a high-capacity cutting head drive can be used. It will be understood that, for the purpose of achieving high tunnelling capacities, the capacity of the cutting head drive is so regulated that, irrespective of the particular condition of the rock to be cut, the nominal capacity of the cutting head drive can be exploited as fully as possible, while avoiding overloading thereof; and, only in the case of small angles, is the use of the full capacity of the cutting head drive intentionally dispensed with.

The invention also provides apparatus for regulating the capacity of a tunnelling machine having a rotatable cutting head mounted at one end of an arm, the other end of the arm being pivotally mounted in the chassis of the tunnelling machine about a pivot pin whose axis extends transversely to the axis of the arm, a hydraulic rotary drive being provided for rotating the arm about the axis of the tunnel being formed, the regulation apparatus including a device for measuring the angle between the axes of the arm and the tunnel, and a regulator for regulating the pressure of the hydraulic fluid supplied to the hydraulic rotary drive in dependence upon said angle, the regulation apparatus being such that the pressure of hydraulic fluid supplied to the hydraulic rotary drive decreases as said angle decreases.

Advantageously, said device is an angle/current transducer.

The invention further provides a tunnelling machine having a chassis, an arm pivotally mounted on the chassis about a pivot pin whose axis extends transversely to the axis of the arm, a rotatable cutting head mounted at the free end of the arm, a rotary drive for rotating the arm about the axis of the tunnel being formed, a drive for driving the cutting head, and apparatus for regulating the capacity of the cutting head, wherein the regulation apparatus is as defined above.

Advantageously, the cutting head drive is an electric motor and the rotary drive of the arm is a hydraulic motor. Preferably, the machine further comprises a sensor for sensing the current supplied to the electric motor and for sending an appropriate control signal to the regulator, whereby the capacity of the hydraulic motor is inversely proportional to the current supplied to the electric motor.

Preferably, the regulation apparatus is such that the capacity of the cutting head drive decreases only when the decrease in said angle reaches a predetermined angle. If said angle is greater than the predetermined angle, work can proceed with full use of the nominal capacity of the cutting head drive. Only when the predetermined angle is reached, is the rotary drive of the arm so controlled that work can proceed only at a predetermined partial capacity of the cutting head drive. Thus, no damage or destruction of the arm or its bearings can occur. During such an incremental regulation, work can proceed using one or more steps. However, instead of incremental regulation work can proceed using a continuous regulation of capacity. In this case, as said angle decreases, utilisation of the capacity of the cutting head drive can be continually reduced by suitably reducing the thrust and/or the pressure of the cutting head against the work face.

When a hydraulic rotary drive is used for driving the arm, the machine may further comprise a pump for supplying hydraulic fluid to the hydraulic motor, the output of the pump being adjusted by means of a control element controlled by the regulator. Preferably, the control element is constituted by a hydraulic piston-and-cylinder unit, and wherein a servo-valve is provided for controlling the pressure of the hydraulic fluid supplied to the working chamber of the piston-and-cylinder unit, the servo-valve being actuated by the regulator.

BRIEF DESCRIPTION OF THE DRAWINGS

A tunnelling machine incorporating regulation apparatus constructed in accordance with the invention will now be described, by way of example, with reference to the accompanying drawings, in which.

DESCRIPTION OF PREFERRED EMBODIMENT

Figure 1:
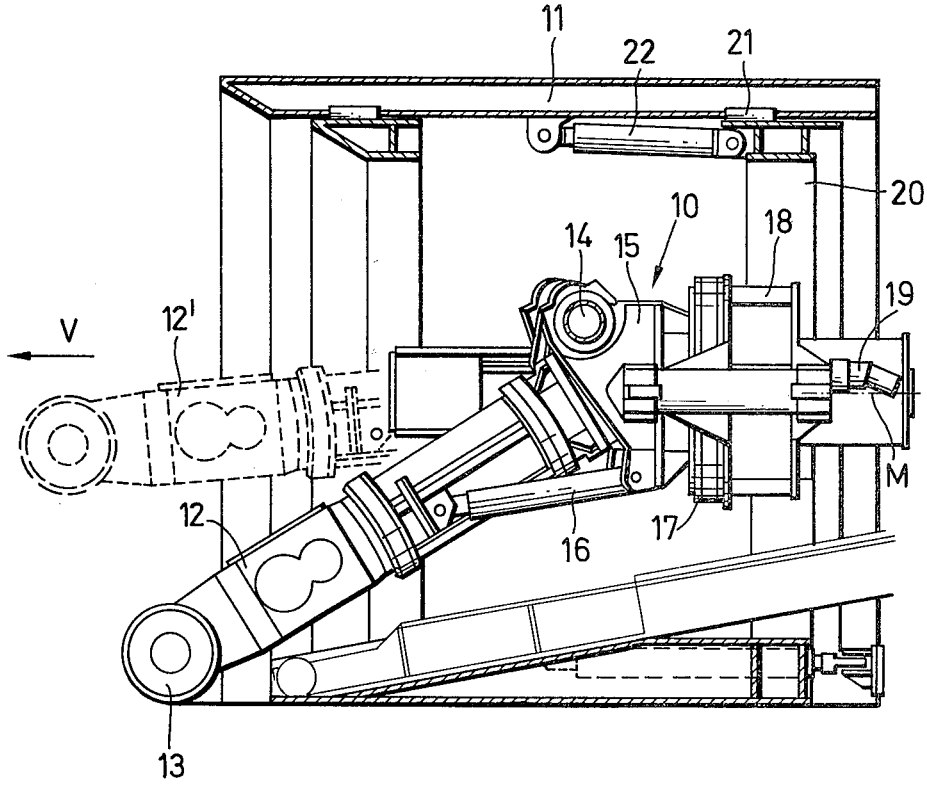
FIG. 1 is a diagrammatic side elevation of the tunnelling machine.

Referring to the drawings, FIG. 1 shows a tunnelling machine 10 which is mounted in a cylindrical tunnel drive shield 11 in such manner that it can be advanced in the tunnelling direction V. The tunnelling machine 10 has a cutting head 13 carried at the free end of an elongate arm or jib beam 12, the cutting head consisting of two cutting rolls which are rotatable about a common axis of rotation extending at right-angles to the axis of the arm. The cutting head 13 is driven by an electric motor (not shown) which is arranged within the arm 12. The arm 12 is pivotally mounted on a carrier 15 by means of a pivot bearing 14 having a pivot pin extending at right-angles to the axis of the arm. A hydraulic ram 16 is pivoted between the carrier 15 and the arm 12, the ram 16 being used to pivot the arm about the axis of the pivot bearing 14. The ram 16 is also used to lock the arm 12 in any desired position.

The carrier 15 is connected, by means of a pivot bearing 17, to a bearing member 18. The bearing member 18 is supported and guided by means of diametrically-opposed guide arms (not shown), on guide rails (not shown) which are arranged half-way up on the inner wall of the drive shield 11. The axis of rotation of the pivot bearing 17 coincides with the shield axis (and with the axis M of the tunnel being formed). The entire arm 12, together with the cutting head 13 and the carrier 15, is rotatable relative to the bearing member 18, by means of a hydraulic rotary drive 19, about the axis of rotation of the pivot bearing 17.

Alternatively, the tunnelling machine 10 can be displaced within the drive shield 11 by means of an annular guide member 20 which moves in guides 21 on the inner wall of the drive shield 11, the guide member 20 being axially displaceable within the shield by means of hydraulic rams 22.

In either case, however, it will be apparent that the tunnelling machine can be advanced towards the workface, that is to say in the direction of the arrow V. Moreover, the arm 12, together with the cutting head 13 can be rotated about an axis which coincides with the axis of the shield (the axis M of the tunnel), for all angular positions of the arm 12. Consequently, it is possible to carry out the tunnelling work in such a way that, with the arm 12 set to the greatest diameter of the excavation cross-section, an annular cut of predetermined depth can be made, the rotary drive 19 being used to drive the arm in a complete arc. Then, with the aid of the ram 16, the arm 12 can be swung inwards through a predetermined angle. With the arm 12 in this new angular position, a second annular cut can be made, this second cut being concentric with the first cut. Subsequent annular cuts can be made following further inward movement of the arm 12. Finally, when the axis of the arm 12 substantially coincides with the axis M of the tunnel, a central, circular cut can be made, and a smooth excavation wall obtained. As mentioned above, as cutting takes place, the angle between the axis of the arm 12 and the axis M of the tunnel is reduced incrementally.

Figure 2:
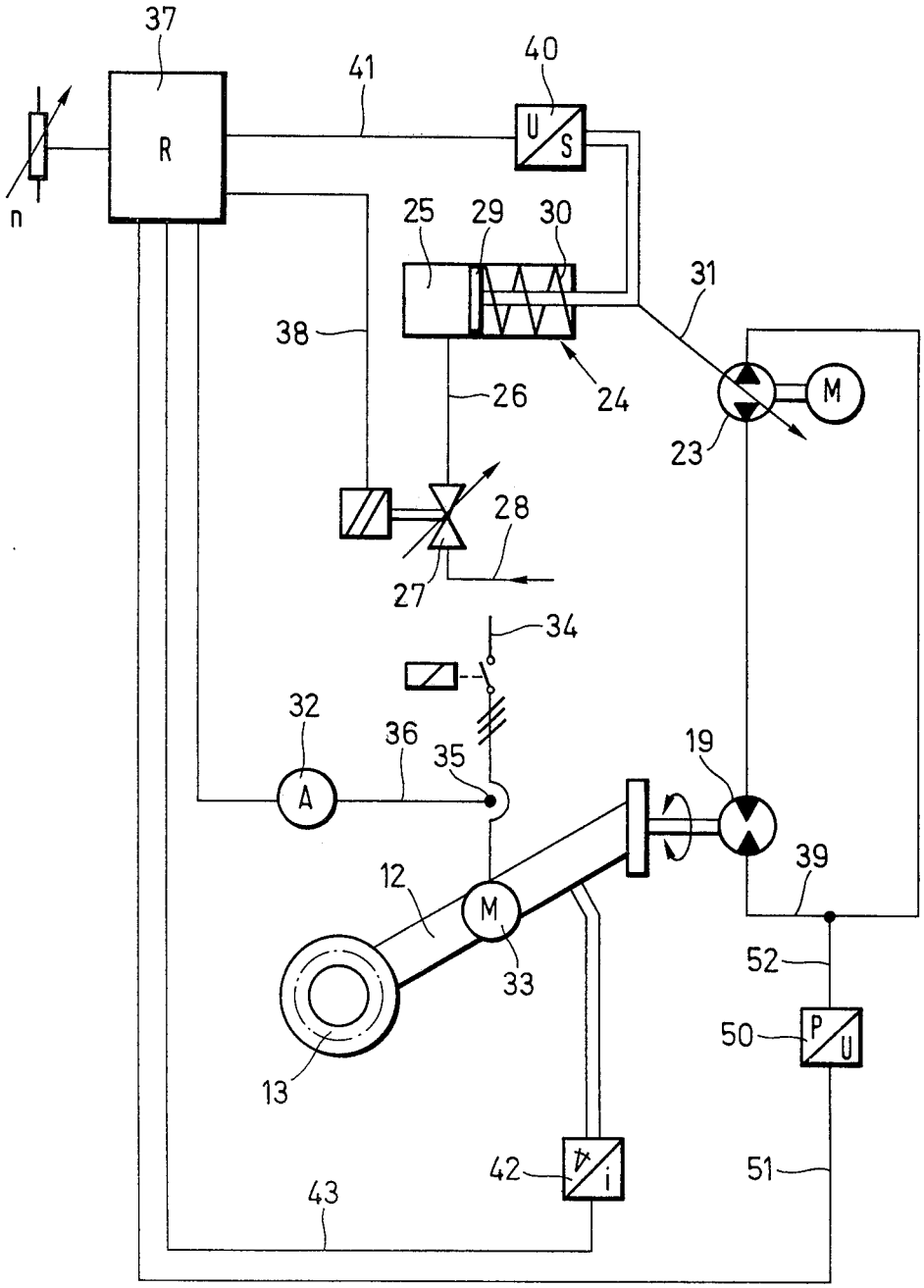
FIG. 2 is a circuit diagram showing the regulation apparatus of the tunnelling machine of FIG. 1.

FIG. 2 is a circuit diagram showing means for regulating the tunnelling machine 10. The rotary drive 19, which consists of at least one hydraulic motor, is positioned in a hydraulic circuit 39 which includes a pump 23 whose output is controlled by means of a control element 24. The control element 24 is a hydraulic piston-and-cylinder unit, the working chamber 25 of which is connected by a hydraulic line 26, to the outlet of a servo-valve 27. The servo-valve 27 is a pressure regulating valve, whose inlet is connected to a hydraulic supply line 28. The direction of rotation of the rotary drive 19 can be controlled by the servo-valve 27 in a known manner, for example by displacing the pump 23 beyond its zero position. When pressurised hydraulic fluid is admitted to the working chamber 25 of the control element 24, its piston 29 is extended against the force of a return spring 30. The piston 29 is connected, by a mechanical link 31, to the pump 23. Thus, the output of the pump 23 can be varied in dependence upon the hydraulic pressure in the working chamber 25 of the control element 24. The outlet of the pump 23 is connected to the hydraulic rotary drive 19.

The cutting head 13 is powered by a three-phase motor 33, which is supplied with electric current by a three-phase supply 34. An electrical sensor, preferably a current transducer 35, senses the current drawn from the three-phase supply 34, and transmits a signal proportional to the sensed current to a regulator 37 via a line 36. To provide an optical check, an ammeter 32 is provided in the line 36. The output of the regulator 37 is connected, by a line 38, to the servo-valve 27. The servo-valve 27 is thus controlled so that the pressure of the hydraulic fluid supplied to the working chamber 25 of the control element 24 is dependent upon the magnitude of the electrical signal passing along the line 38. The displacement of the servo-valve 27 is sensed by a distance/voltage transducer 40, which transmits a signal proportional to the sensed distance, this signal being sent to the regulator 37 via a line 41. The regulator 37 controls the voltage in the line 38 in inverse proportion to the current of the three-phase supply 34. Consequently, the output of the pump 23 is controlled by the control element 24 in such a manner that the output decreases when the current of the three-phase supply 34 rises, and increases when said current falls. The hydraulic rotary drive 19 of the arm 12 is, therefore, so controlled by the pressure of the hydraulic fluid that, during cutting operations, the nominal capacity of the cutting-head drive 33 is fully utilised. On the other hand, overloading of the cutting-head drive 33 is prevented. Thus, the cutting-head 13 of the tunnelling machine operates in soft earth with a greater thrust than in solid earth or rock. A pressure/voltage transducer 50, is connected between the regulator 37 and the hydraulic circuit 39. The transducer 50 may be a pressure cell, and is connected to the regulator 37 by a line 51 and to the hydraulic circuit 39 by a line 52. The transducer 50 limits the pressure in the hydraulic circuit 39 to a predetermined maximum valve.

As previously mentioned, the ram 16 is used to swing the arm 12 out at different angles to the axis M of the tunnel. The cutting head drive 33 has a nominal capacity such that, in the swivelled position of the cutting arm 12 shown in solid lines in FIG. 1 (that is to say when the arm 12 is swung out to the maximum extent), the greatest possible tunnelling rate is achieved. When the cutting arm 12 is swung into the position shown in broken lines 12' in FIG. 1 (that is to say when the angle of deflection between the axis of the arm and the axis M of the tunnel is reduced), the arm is subjected to greater moments of reaction, and these moments increase still further as the arm is swung-in further. These large moments of reaction may damage the arm 12 and its bearings if these parts are not of excessively robust design, and this of necessity results in a considerably greater cost of the equipment. To avoid this disadvantage, the rotary drive 19 of the tunnelling machine is so controlled that the rate of thrust and/or the pressure exerted by the cutting head 13 on the workface are automatically reduced as the arm 12 is swung inwards. This control is accomplished using an angle/current transducer 42 which measures the angle of deviation of the arm 12 from the axis M, and which is connected, by a line 43, to the regulator 37. The transducer 42 acts, via the regulator 37, to reduce the rate of thrust and/or of the pressure applied by the cutting head 13. Thus, on receiving a control signal via the line 43, the regulator 37 acts to reduce the output of the pump 23, which results in a reduction of the pressure of the hydraulic fluid supplied to the rotary drive 19. Thus, the control of the thrust of the cutting head 13 in dependence upon the angle of deviation of the arm 12 protects the tunnelling machine against overloading. The transducer 42 may act so that the reduction of the pressure supplied to the rotary drive 19 occurs only when a predetermined angle of deviation is reached.

Thus, control of the thrust of the cutting head 13 in dependence upon the angle of deviation of the arm 12 is combined with the normal regulation of drive capacity.

We claim:

1. Apparatus for regulating the capacity of a tunnelling machine having a rotatable cutting head mounted at one end of an arm, the other end of the arm being pivotally mounted in the chassis of the tunnelling machine about a pivot pin whose axis extends transversely to the axis of the arm, a rotary drive for rotating the arm about the axis of the tunnel being formed, and drive means for rotatably driving the cutting head about the longitudinal axis of said arm, the regulation apparatus comprising: regulator means for regulating the rotary drive of the arm in dependence upon the capacity of the cutting head drive means, and a device for measuring the angle between the axes of the arm and the tunnel, said regulator means being responsive to an output of said measuring device for decreasing the capacity of the rotary drive as said angle decreases, thereby reducing the force applied by the cutting head to a working face.

2. Apparatus according to claim 1, wherein the regulation apparatus is such that the capacity of the cutting head drive decreases only when the decrease in said angle reaches a predetermined angle.

3. Apparatus according to claim 1, wherein said measuring device is an angle/current transducer.

4. A tunnelling machine having a chassis, an arm pivotally mounted on the chassis about a pivot pin whose axis extends transversely to the axis of the arm, a rotatable cutting head mounted at the free end of the arm, a rotary drive for rotating the arm about the axis of the tunnel being formed, drive means for rotatably driving the cutting head about the longitudinal axis of said arm, and apparatus for regulating the capacity of the cutting head, the regulation apparatus comprising regulator means for regulating the rotary drive of the arm in dependence upon the capacity of the cutting head drive means, and a device for measuring the angle between the axes of the arm and the tunnel, said regulator means being responsive to an output of said measuring device for decreasing the capacity of the rotary drive as said angle decreases, thereby reducing the force applied by the cutting head to a working face.

5. A tunnelling machine according to claim 4, wherein the regulation apparatus is such that the capacity of the cutting head drive decreases only when the decrease in said angle reaches a predetermined angle.

6. A tunnelling machine according to claim 4, wherein said measuring device is an angle/current transducer.

7. A tunnelling machine according to claim 4, wherein the cutting head drive is an electric motor and the rotary drive of the arm is a hydraulic motor.

8. A tunnelling machine according to claim 7, further comprising a sensor for sensing the current supplied to the electric motor and for sending an appropriate control signal to the regulator means, whereby the capacity of the hydraulic motor is inversely proportional to the current supplied to the electric motor.

9. A tunnelling machine according to claim 8, further comprising a pump for supplying hydraulic fluid to the hydraulic motor, the output of the pump being adjusted by means of a control element controlled by the regulator means.

10. A tunnelling machine according to claim 9, wherein the control element is constituted by a hydraulic piston-and-cylinder unit, and wherein a servo-valve is provided for controlling the pressure of the hydraulic fluid supplied to the working chamber of the piston-and-cylinder unit, the servo-valve being actuated by the regulator means.

11. Apparatus for regulating the capacity of a tunnelling machine having a rotatable cutting head mounted at one end of an arm, the other end of the arm being pivotally mounted in the chassis of the tunnelling machine about a pivot pin whose axis extends transversely to the axis of the arm, a hydraulic rotary drive being provided for rotating the arm about the axis of the tunnel being formed, the regulation apparatus including a device for measuring the angle between the axes of the arm and the tunnel, and a regulator for regulating the pressure of the hydraulic fluid supplied to the hydraulic rotary drive in dependence upon said angle, the regulation apparatus decreasing the pressure of hydraulic fluid supplied to the hydraulic rotary drive as said angle decreases, thereby reducing the force applied by the cutting head to a working face.

12. A tunnelling machine having a chassis, an arm pivotally mounted on the chassis about a pivot pin whose axis extends transversely to the axis of the arm, a rotatable cutting head mounted at the free end of the arm, a hydraulic rotary drive for rotating the arm about the axis of the tunnel being formed, a drive for driving the cutting head, and apparatus for regulating the capacity of the cutting head, the regulation apparatus including a device for measuring the angle between the axes of the arm and the tunnel, and a regulator for regulating the pressure of the hydraulic fluid supplied to the hydraulic rotary drive in dependence upon said angle, the regulation apparatus decreasing the pressure of hydraulic fluid supplied to the hydraulic rotary drive as said angle decreases, thereby reducing the force applied by the cutting head to a working face.

* * * * *